United States Patent [19]

Obenshain

[11] Patent Number: 4,639,969

[45] Date of Patent: Feb. 3, 1987

[54] DOOR CLOSER MECHANISM

[76] Inventor: D. Noel Obenshain, Rte. 1, Box 1191, Swanton, Md. 21561

[21] Appl. No.: 690,102

[22] Filed: Jan. 9, 1985

[51] Int. Cl.[4] ..... E05F 3/02

[52] U.S. Cl. ..... 16/70; 16/66; 16/65; 16/80; 16/84

[58] Field of Search ..... 16/49, 58, 84, 61, 66, 16/62, 70, 64, 65, 79, 80, DIG. 10, DIG. 17; 403/DIG. 1

[56] References Cited

U.S. PATENT DOCUMENTS

| | | | |
|---|---|---|---|
| 1,097,605 | 5/1914 | Voight | 16/62 |
| 1,728,693 | 9/1929 | Moore et al. | 16/49 |
| 2,277,316 | 3/1942 | Garrison | 16/49 X |
| 2,471,707 | 5/1949 | Van Veen et al. | 16/62 |
| 2,550,775 | 5/1951 | Clark | 403/DIG. 1 |
| 2,920,338 | 1/1960 | Falk | 16/49 |

*Primary Examiner*—James M. Meister
*Assistant Examiner*—John L. Knoble

[57] ABSTRACT

This is an improved door closer mechanism for attachment to, or incorporation into, a standard spring type door closer, or for use with a standard spring type door closer. It is particularly useful for screen or storm doors. The unique feature is a reversible pawl and ratchet assembly operating on a rod between the door and door casing, which allows the door to ratchet open freely to any desired position where it is held by the pawl until a slight closing pull or push on the door reverses action of the pawl and allows the door to close freely. While the door is closing or is fully closed, reopening of the door resets the pawl for again holding the door open as desired. Reversing of the pawl is fully automatic, and nothing has to be manually touched except the door itself.

2 Claims, 11 Drawing Figures

A
A

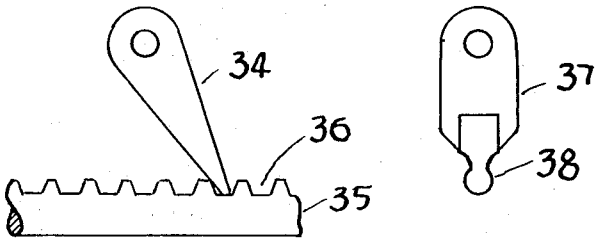
FIG. 11
FIG. 10
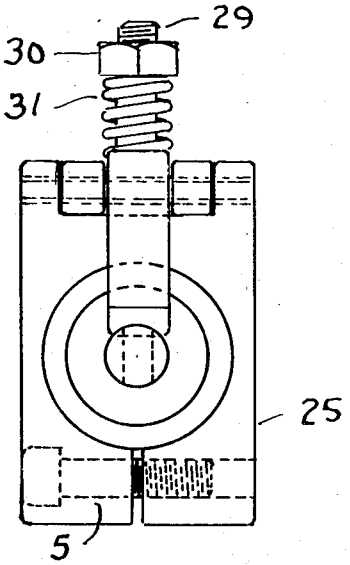
FIG. 9
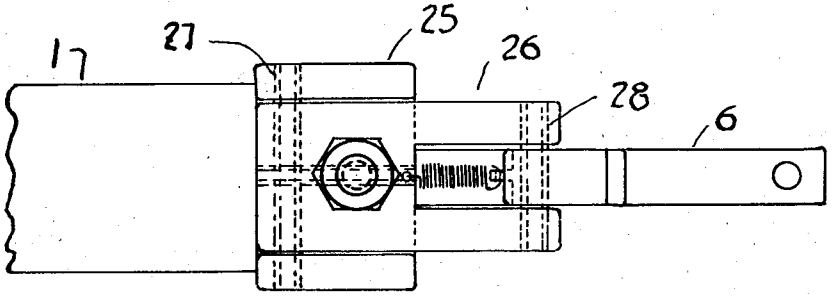
FIG. 8
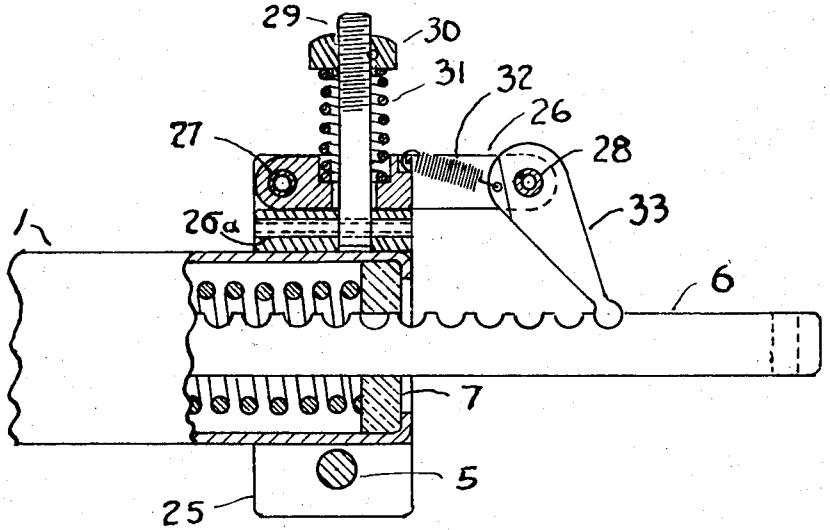
FIG. 7

DOOR CLOSER MECHANISM

BACKGROUND OF THE INVENTION

Conventional spring type door closers, especially screen or storm door closers, have the annoying tendency to shove, push or otherwise interfere with the person entering, or to close on the heels of the person. This is particularly true when the person is carrying packages or other items, or has to get out a key for unlocking the main door. Often, needed screen or storm doors are not installed due to this very problem. This inventor had this problem for many years, hoping some manufacturer would develop and supply a door closer which would overcome the problem. But, none did. That is what led to this invention.

SUMMARY OF THE INVENTION

Door closers with this improved mechanism are relatively simple, and are reasonably inexpensive to manufacture. They can be easily installed by most home owners with very simple tools.

They employ basically an automatic reversible pawl and ratchet mechanism which will allow the door to ratchet open easily. When the door is stopped in any desired position and gently released, it will remain in that position. If opened and released quickly, the door will immediately close, the same as without the mechanism.

When stopped at any desired position, the door may be closed by giving a slight pull from inside, or a slight push from outside, after which the door will close fully.

The door may also be closed from a holding position, by giving a slight push and quick release from inside. This is generally the preferred closing method, and may be done with the elbow or body, thereby leaving both hands free.

The door, while closing, may be stopped and returned to a holding position, by pushing outward on the door.

All functions are performed quite naturally, and all without touching anything except the door itself.

If ever desired to delete the hold action, such as with children around who sometimes forget to close doors, the pawl may be manually moved up to its inactive position where it will remain until returned. For temporarily opening the door beyond its normal limit of travel, the hinge pin at the door casing mounting bracket may be removed.

BRIEF DESCRIPTION OF THE DRAWINGS

FIG. 7 is a partial longitudinal section similar to FIG. 1 except with one of a number of alternate means for mounting and loading the pawl. It also illustrates a pawl centering spring for use with non-magnetic pawls.

FIG. 8 is a top view of FIG. 7.

FIG. 9 is a rod end view of FIG. 7.

FIG. 10 illustrates one of many possible variations of grooves and pawls which may be used with the mechanism.

FIG. 11 illustrates one of many possible alternate means for making magnetic pawls.

DETAILED DESCRIPTION OF THE DRAWINGS

Figures 1, 2, 3:
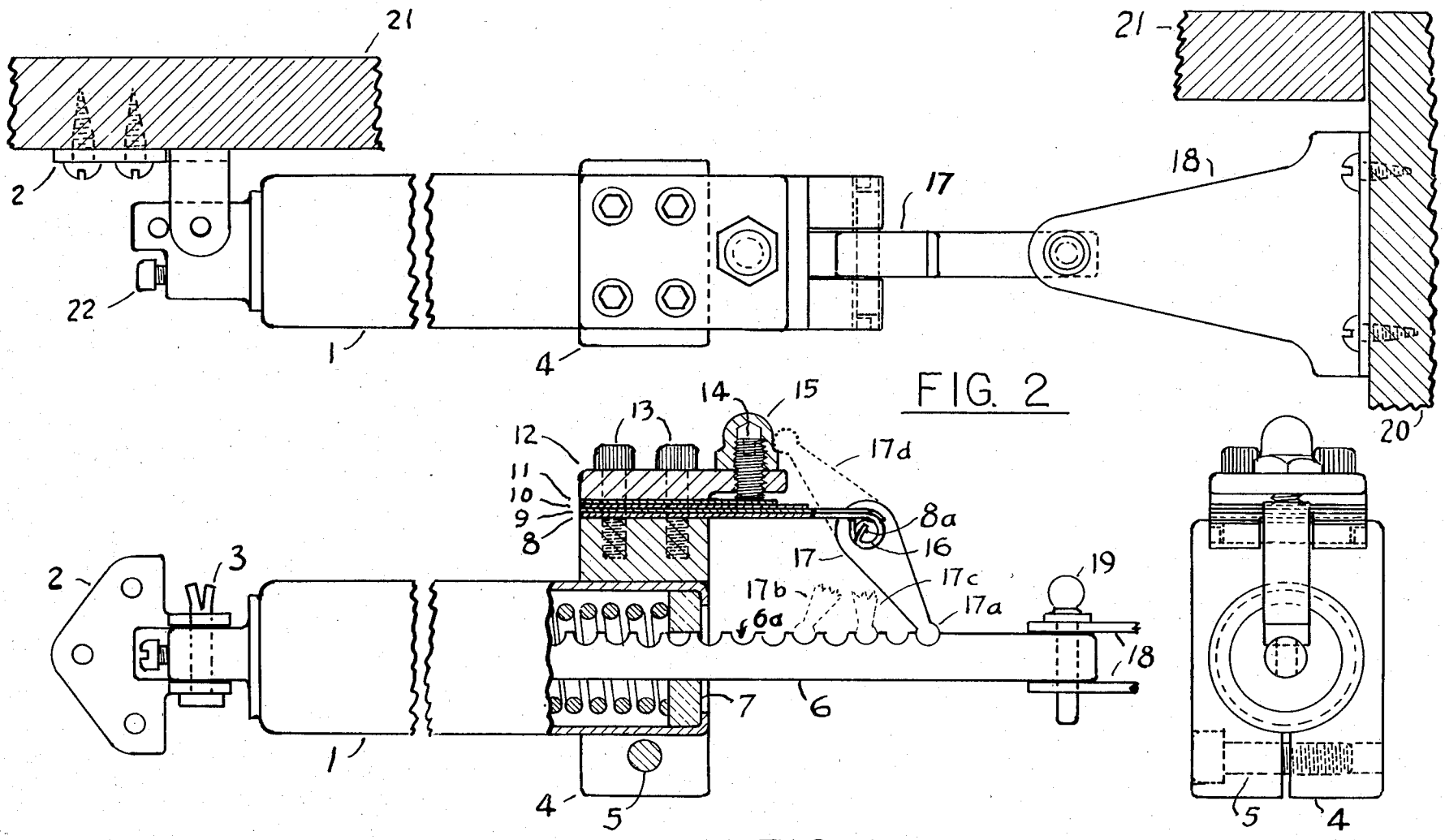
FIG. 1 is a longitudinal and partial sectional view of the closer mechanism, showing a typical cylinder with piston and closing spring inside, the grooved piston rod, the pawl and its mounting means.
FIG. 2 is a top view of the closer mechanism, showing the connections to the door and door casing.
FIG. 3 is a view from the end of the piston rod and shows how the mounting means for the pawl is attached to the cylinder.

In FIG. 1 and FIG. 2, part 1 is the cylinder of a standard spring type door closer, such as manufactured by National Manufacturing Company, Sterling, IL; Wright Products, Inc., Rice Lake, WI; Ideal Security Hardware Company, St. Paul, Minn.; and others. The cylinder has inside a pneumatic piston, not shown, a piston rod and a door closing spring. It has a bracket 2 for attachment to the door 21 and a pivot pin 3 for attachment to the cylinder. An adjustable air release screw 22 permits adjusting the closing velocity of the door. The cylinder has a bushing 7 through which the piston rod 6 slides. The normally smooth piston rod 6 is modified by having notches or grooves *6a* made in its upper surface as shown, to receive the end of pawl 17. These grooves *6a* preferably have rounded bottoms as shown. Typical radius of the grooves is 3/32 inch and typical depth 0.100 inch. Other types of grooves such as shown 36 in rod 35 of FIG. 10, may be used and the pawl such as 34 shaped to fit the grooves. Typical spacing of the grooves is around ¼ inch center to center, but may be varied widely.

The end of the piston rod 6 is connected to the door casing 20 by means of bracket 18 and removable pin 19. This pin 19 may be removed when it is desired to temporarily open the door wider than the limit of the closer.

In FIG. 1, the mounting block 4 is clamped to cylinder 1 by means of draw screw 5, as illustrated in FIG. 3. The upper surface of block 4 has 4 tapped holes for screws 13, which by means of plate 12 clamp flat springs 8, 9, 10, 11 to the block.

Satisfactory flat springs have been made from standard steel strapping such as used for holding cargo in place in railway box cars. The nominal width is 1¼ inches and the thickness 0.0325 inch. Other spring materials of similar characteristics may be used. Four plys have been found satisfactory for providing a horozontally firm vertically flexible mounting for the pawl 17. The bottom spring 8 has a gap at is outer end slightly wider than pawl 17, see FIG. 2, and deep enough to clear the pawl when it is in the inactive position *17d*. Before bending the ends of spring 8 to form bearings for pivot shaft 16, longitudinal slits are made in the ends ⅛ inch from the outer edges and ¼ inch deep. After assembly, and with pawl pivot shaft 16 in place, these slit ends are bent as shown *8a*, to keep the pivot shaft 16 in place. Spring 9 is similar to spring 8 but shorter. Its outer ends are curved slightly downward as shown. Spring 10 is still shorter and spring 11 is the shortest of the four springs. Altogether, they provide the firm flexible mounting required for pawl 17.

In FIG. 1, the piston rod is shown fully retracted, as it would be when the door is fully closed. When opening the door, piston rod 6 is withdrawn from the cylinder and the pawl slides freely over the grooves. When the door is stopped, the spring in the cylinder tends to close the door and the pawl drops into the nearest groove and resists closing of the door until the pawl pushing up on the spring assembly 8, 9, 10, 11 passes through position 17*c* and on to position 17*b*, after which the pawl rides freely over the grooves until the door is fully closed. When fully closed, the pawl will be in the groove at position 17*b*. When the door is again opened, the pawl will go through angular positions 17*b* to 17*c* to 17*a*, and allow the door to open freely against the cylinder spring. To provide the desirable holding action for the door, adjusting screw 14 is tightened down on the spring assembly, so that when the door is opened and stopped, and starts to close, the door closing spring will almost, but not quite, move the pawl through position 17*c*. Thus, the door will remain stationary in the opened position. When additional manual closing force is applied to the door, it will cause the pawl to flip through and past position 17*c* to position 17*b*, thereby allowing the door to close freely. When the door is again opened, the pawl is flipped from position 17*b*, through position 17*c* to position 17*a*, ready to again hold the door open when stopped.

When the door is closing, the pawl is of course in position 17*b*. If while closing, it is desired to stop the door before fully closed, a manual push outward on the door will cause the pawl to flip from position 17*b*, through 17*c* to 17*a*, where it will hold the door at the desired open position.

If the door is being held in the desired open position, a slight push outward on the door and quick release, will allow the closing inertia of the door to flip the pawl to the release position 17*b*, and allow the door to close freely. This is actually one of the preferred motheds of closing the door. The elbow can often be used for the outward push, leaving both hands free for other purposes.

If it is desired to open the door without its holding in the open position, a quick release when opening, will allow the closing inertia of the door to flip the pawl to position 17*b* and allow the door to close freely. This is helpful when going out hurriedly.

Thus, the door responds almost automatically to any desired mode of operation, with almost no conscious effort by the operator. It almost appears to "think" for itself.

In case it is ever desired to delete the hold action for an extended period of time, such as when small children are around who often forget to close doors, the door may be opened slightl and the pawl manually moved to position 17*d*, where it will remain magnetically attracted to the lock nut 15. To restore holding action, the pawl is manually returned to position 17*a*.

The pawl 17 as shown in FIG. 1 is magnetized, so that the end engaging the grooves in the piston rod, will not bounce out of the grooves. Such bouncing has been found to cause erratic action of the closer. The pawl may be made of suitably hardened and magnetized steel, or may be made of sintered magnetic material compressed into the form shown. Or, the pawl may be made as shown in FIG. 11 where a magnetic tip is pressed into a non-magnetic pawl body 37. The tip is part 38.

I case a magnetic pawl is not practical, a small pawl centering spring 32 as shown in FIG. 7 may be employed. The geometry of the spring is arranged to position the pawl vertical when not restrained, so that it will make the end of the pawl ride the grooved rod when moving in either direction, thus minimizing bounce of the pawl.

Figures 4, 5, 6:
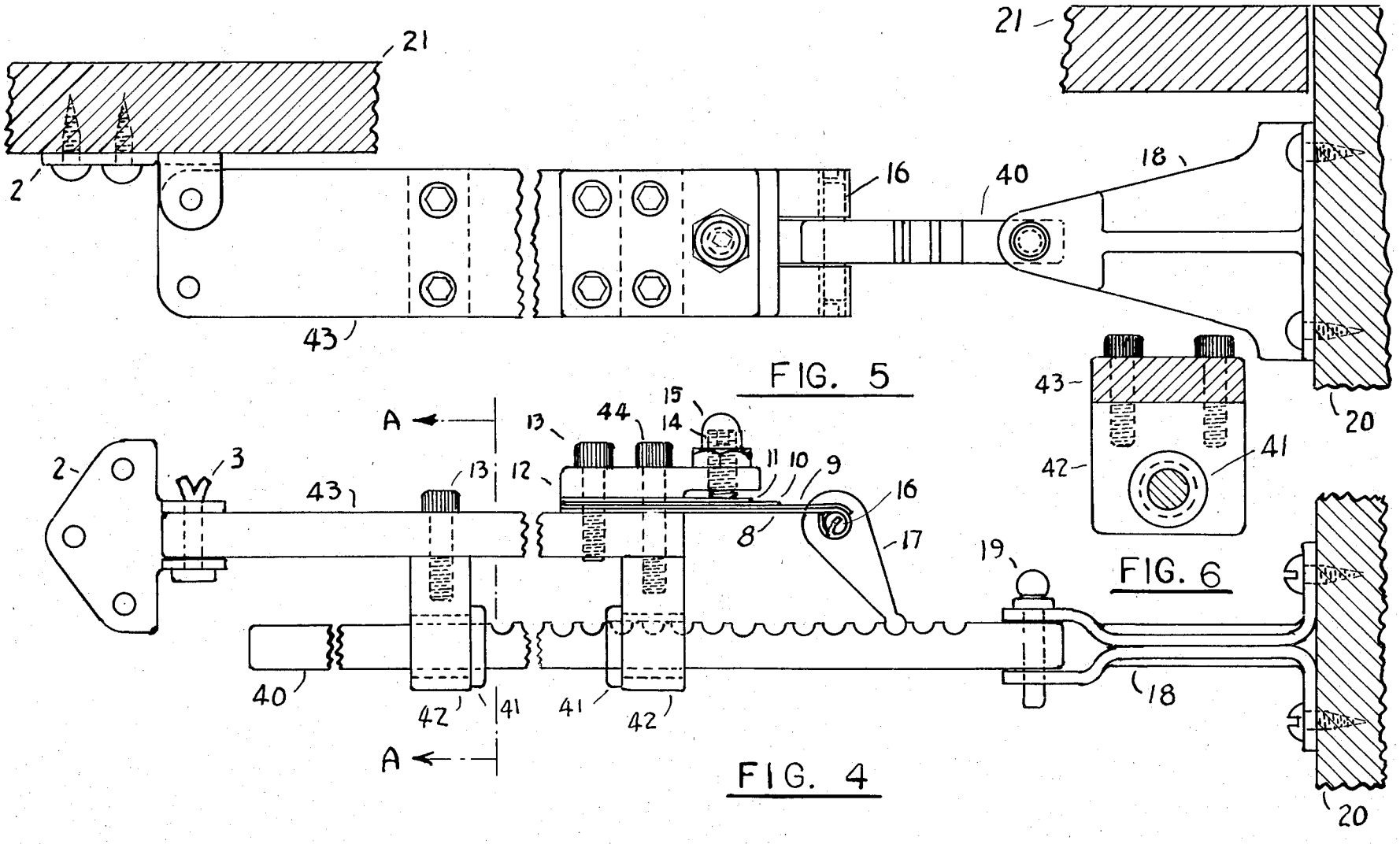
FIG. 4 is a longitudinal view of a closer mechanism without the cylinder, piston and door closing spring, for installation on a door already equipped with, or to be equipped with a spring type door closer.
FIG. 5 is a top view of FIG. 4.
FIG. 6 is a sectional view taken at A—A of FIG. 4.

FIG. 4 shows how the holding action may be employed when the door is already equipped with, or will be equipped with a standard spring type door closer. Here, ratchet rod 40 replaces the piston rod 6 of FIG. 1. It is grooved the same as the piston rod 6. Pawl 17 and springs 8, 9, 10, 11 are identical to those in FIG. 1. Also, parts 12, 14, 15, 16 are identical to those in FIG. 1. Mounting bar 43 takes the place of cylinder 1, and is attached to door 21 by means of bracket 2 and pin 3. Bar 43 has attached to it two bearing blocks 42, each of which has a bushing 41 to support ratchet rod 40. Screws 13 and 44 hold the bearing blocks to bar 43. Mounting bracket 18 and pin 19 provide attachment of rod 40 to door casing 20. FIG. 6 is a sectional view of FIG. 4 taken at A—A, and gives further details of bearing blocks 42. FIG. 5 is a top view of FIG. 4, and shows the whole assembly attached to door 21 and to door casing 20.

FIGS. 7, 8, 9 show one of many possible structural variations of the improved door closer mechanism. Cylinder 1 with piston and door closing spring inside, has bushing 7 and grooved piston rod similar to FIG. 1. Mounting block 25 is clamped to the end of cylinder 1 by means of draw screw 5 as shown in rod end view FIG. 9. The top of block 25 is machined to receive pawl yoke 26 which is hinged to the block by means of roll pin 27. Non-magnetic pawl 33 is pivoted to the yoke 26 by means of roll pin 28. The top of yoke 26 is recessed to accept bottom of coil spring 31 and has hole through which rod 29 passes. Spring loading rod 29 is anchored to top of block 25 by means of roll pin 26*a*. Roll pins are standard hardware items. They are hollow and made of spring steel and have a longitudinal slot along one side. They may be readily driven into nominal size holes, where they will remain until driven out. For free pivoting, extra clearance is provided, such as in the yoke 26 and pawl 33. Self-locking nut 30 is provided to adjust tension of spring 31. Since a non-magnetic pawl is shown, a centering spring 32 is required as explained previously. If a magnetic pawl is used, the centering spring may be deleted. FIG. 8 is top view of FIG. 7, and FIG. 9 is a rod end view of FIG. 7. Parts are all numbered the same as in FIG. 7.

Many other structural variations and modifications may be devised by those skilled in the art, without departing from the basic principle and scope of this invention.

I claim:

1. An improved door closer mechanism of the type comprising a piston-cylinder assembly pivotally mounted on one side to a door by means of a first bracket and on the other side to a wall by means of a second bracket, the improvement comprising:

a series of grooves or notches on the piston rod of the piston-cylinder assembly;

a mounting block clamped to the cylinder of said piston-cylinder assembly;

a number of flat springs clamped onto said mounting block, one flat spring proximate said cylinder having one end distant from said block that is bent to form a bearing for a pivot shaft; a pawl mounted on said pivot shaft; and means for adjusting the distance between the distal end of said one flat spring and the piston cylinder assembly, whereby the pawl will engage a selected one of said grooves or notches upon closing of the door so that the door will be slowed or stopped at a selected point.

2. An improved door closure mechanism as recited in claim 1 wherein the pawl is magnetized to prevent it from escaping any one of said grooves.

* * * * *